US008941704B2

(12) United States Patent
Suzuki et al.

(10) Patent No.: US 8,941,704 B2
(45) Date of Patent: Jan. 27, 2015

(54) IMAGE RECORDING APPARATUS

(71) Applicant: FUJI XEROX Co., Ltd., Minato-Ku, Tokyo (JP)

(72) Inventors: Wataru Suzuki, Kanagawa (JP); Atsushi Ogihara, Kanagawa (JP); Shuichi Nishide, Kanagawa (JP); Tetsuji Okamoto, Kanagawa (JP); Koichi Watanabe, Kanagawa (JP); Masamichi Kimura, Kanagawa (JP)

(73) Assignee: FUJI XEROX Co., Ltd., Tokyo (JP)

( * ) Notice: Subject to any disclaimer, the term of this patent is extended or adjusted under 35 U.S.C. 154(b) by 242 days.

(21) Appl. No.: 13/681,007

(22) Filed: Nov. 19, 2012

(65) Prior Publication Data

US 2013/0308989 A1 Nov. 21, 2013

(30) Foreign Application Priority Data

May 17, 2012 (JP) ..... 2012-113269

(51) Int. Cl.

| | |
|---|---|
| ***B41J 2/325*** | (2006.01) |
| ***G03G 15/16*** | (2006.01) |
| ***G03G 15/20*** | (2006.01) |
| ***G03G 15/24*** | (2006.01) |

(52) U.S. Cl.

CPC ..... *G03G 15/1665* (2013.01); *G06G 15/81685* (2013.01); *G03G 15/2053* (2013.01); *G03G 15/24* (2013.01)

USPC ..... 347/213

(58) Field of Classification Search

USPC ..... 347/171, 187, 193, 101, 104, 105, 141, 347/195, 213, 215, 217, 218; 399/271

See application file for complete search history.

(56) References Cited

U.S. PATENT DOCUMENTS

| | | | | | |
|---|---|---|---|---|---|
| 5,559,586 | A | * | 9/1996 | Wada | 399/271 |
| 5,650,809 | A | * | 7/1997 | Kitamura | 347/141 |
| 5,708,464 | A | * | 1/1998 | Desie | 347/195 |
| 6,078,346 | A | * | 6/2000 | Isobe et al. | 347/218 |

FOREIGN PATENT DOCUMENTS

| | | | |
|---|---|---|---|
| JP | 58-208073 | A | 12/1983 |
| JP | 61-283569 | A | 12/1986 |

* cited by examiner

*Primary Examiner* — Kristal Feggins

(74) *Attorney, Agent, or Firm* — Sughrue Mion, PLLC

(57) ABSTRACT

An image recording apparatus includes a toner transporting member that transports a toner layer while carrying the toner layer on a first surface of the toner transporting member, the toner transporting member including the first surface and a second surface; a heating unit including heating elements that contact the second surface that is opposite to the first surface of the toner transporting member, and that generate heat in accordance with image information, the first surface contacting a recording medium and carrying the toner layer; and a transferring unit that selectively transfers toner at an image portion to the recording medium as a result of causing each heating element of the heating unit to generate the heat with a temperature of the heating elements at the image portion and a temperature of the heating elements at a non-image portion being different from each other.

5 Claims, 10 Drawing Sheets

IMAGE RECORDING APPARATUS

CROSS-REFERENCE TO RELATED APPLICATIONS

This application is based on and claims priority under 35 USC 119 from Japanese Patent Application No. 2012-113269 filed May 17, 2012.

BACKGROUND

Technical Field

The present invention relates to an image recording apparatus.

SUMMARY

According to an aspect of the invention, there is provided an image recording apparatus including a toner transporting member that transports a toner layer while carrying the toner layer on a first surface of the toner transporting member, the toner transporting member including the first surface and a second surface; a heating unit including heating elements that contact the second surface that is opposite to the first surface of the toner transporting member, and that generate heat in accordance with image information, the first surface contacting a recording medium and carrying the toner layer; and a transferring unit that selectively transfers toner at an image portion to the recording medium as a result of causing each heating element of the heating unit to generate the heat with a temperature of the heating elements at the image portion and a temperature of the heating elements at a non-image portion being different from each other.

BRIEF DESCRIPTION OF THE DRAWINGS

Exemplary embodiments of the present invention will be described in detail based on the following figures, wherein.

DETAILED DESCRIPTION

Embodiments for carrying out the invention (hereunder referred to as "exemplary embodiments") will hereunder be described with reference to the drawings.

First Exemplary Embodiment

Figure 1:
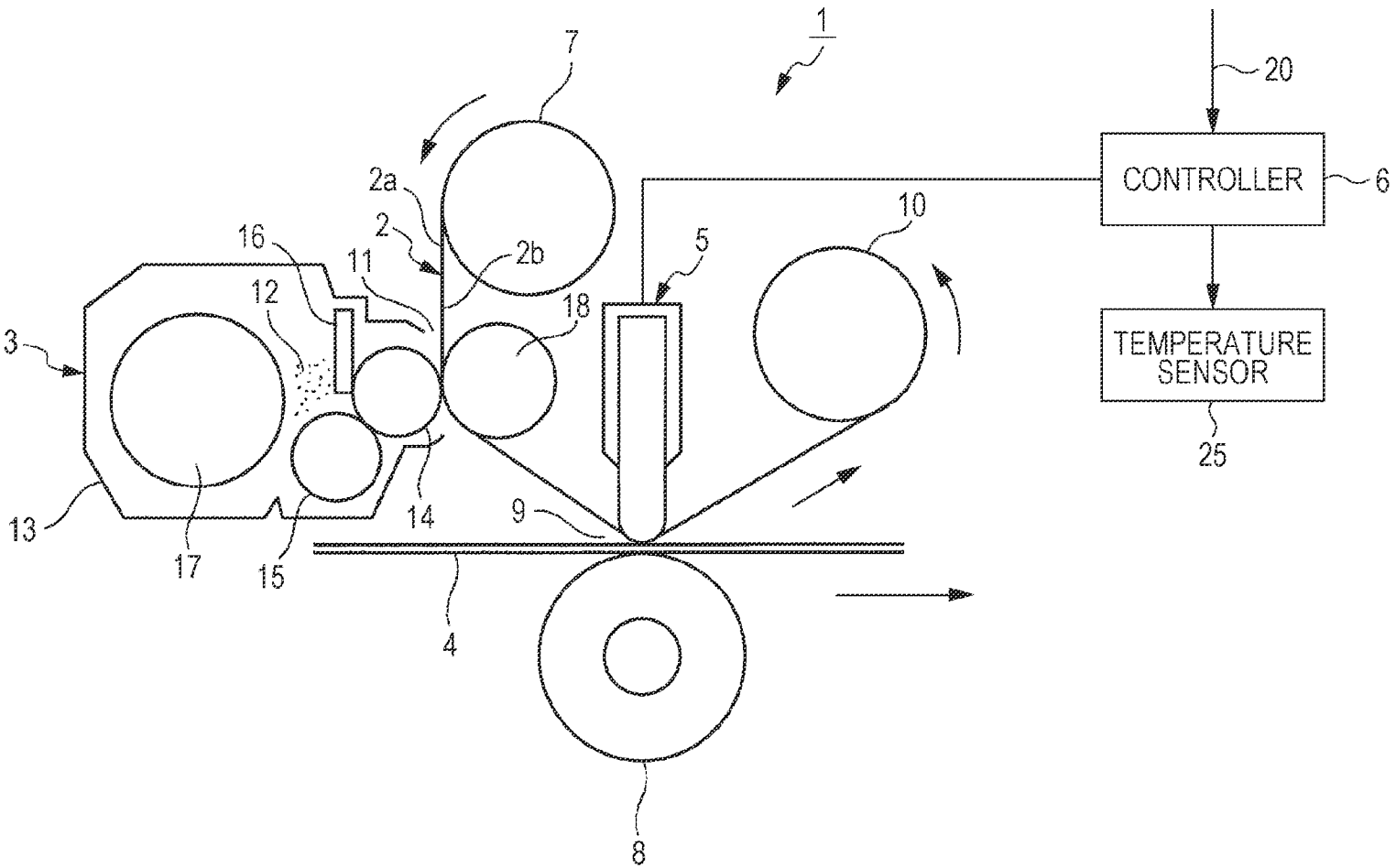
FIG. 1 shows a structure of an image recording apparatus according to a first exemplary embodiment of the present invention.

FIG. 1 shows an image recording apparatus 1 according to a first exemplary embodiment.

Structure of Entire Image Recording Apparatus

The image recording apparatus 1 according to the first exemplary embodiment is formed as, for example, a printer that records an image using heat. The image recording apparatus 1 includes, for example, a film-like toner transporting member 2, a toner layer forming device 3, a heating recording device 5, and a transferring device 6. The toner transporting member 2 transports a toner layer while carrying the toner layer on its surface. The toner layer forming device 3 forms the toner layer on the surface of the toner transporting member 2. The heating recording device 5 includes heating elements that contact a surface 2*b* that is opposite to a surface 2*a* of the toner transporting member 2, and that generate heat in accordance with image information. The surface 2*a* carries the toner layer and contacts recording paper 4 serving as an exemplary recording medium. The transferring device 6 selectively transfers toner at an image portion to the recording paper 4 due to a difference between the temperature of the image portion and the temperature of a non-image portion as a result of causing each heating element of the heating recording device 5 at the image portion and the non-image portion to generate heat.

Structure of Principal Portion of Image Recording Apparatus

The toner transporting member 2 is a film member that transports a toner layer while carrying the toner layer on its surface. The toner transporting member 2 is formed as a long thin film formed of heat-resistant synthetic resin such as polyethylene terephthalate (PET), polyimide, or polyamide, and having a predetermined width. Considering thermal conductivity of the toner transporting member 2, it is desirable that the toner transporting member 2 be thin, and be capable of transporting the toner layer carried by the toner transporting member 2 while suppressing the formation of, for example, wrinkles in the toner layer. Therefore, the thickness of the toner transporting member 2 is set, for example, on the order of 5 to 30 μm. If necessary, a layer providing separability is formed on the surface 2*a* of the toner transporting member 2 at a side that carries the toner layer. The layer providing separability is formed of, for example, polytetrafluoroethylene (PTFE) or polytetrafluoroethylene-perfluoroalkylvinylether copolymer (PFA).

The toner transporting member 2 is supplied from a supply roller 7 upon which the long toner transporting member 2 is wound in the form of a roll, and passes the toner layer forming device 3. Then, the toner transporting member 2 passes a recording position 9 where the heating recording device 5 contacts a back supporting roller 8 with the toner transporting member 2 and the recording paper 4 being disposed therebetween, is transported along the direction of an arrow, and is taken up by a take-up roller 10. When an image is recorded, the take-up roller 10 is rotationally driven along the direction of an arrow by a driving source (not shown), and, when the supply roller 7 rotates in a supplying direction, the supply roller 7 is subjected to a braking force, so that the toner transporting member 2 is supplied and moved at a predetermined speed while being subjected to tension. When the entire toner transporting member 2 has been supplied from the supply roller 7, the supply roller 7 is replaced with a new one. When the supply roller 7 is replaced, the take-up roller 10 is replaced with a new one at the same time.

As shown in FIG. 1, the toner layer forming device 3 forms a layer of toner T on the surface 2*a* of the toner carrying member 2 supplied from the supply roller 7, and has a structure that is similar to a developing device of an image forming apparatus. The toner layer forming device 3 includes a developing roller 14, a stirring transporting member 15 (such as a screw auger), a layer thickness regulating member 16, and a toner containing section 17 in a housing 13. An opening 11 and a chamber for containing developer 12 are formed in the housing 13. The developing roller 14 carries the developer 12, and transports the developer 12 to a toner layer formation area opposing the toner transporting member 2. The stirring transporting member 15 transports the developer 12 so that the developer 14 passes the developing roller 14 while stirring the developer 12. The layer thickness regulating member 16 charges toner in the developer 12 to a predetermined polarity (for example, a negative polarity) if necessary while regulating the amount (layer thickness) of the developer 12 carried by the developing roller 14. The toner containing section 17 contains toner therein, and supplies the toner to the stirring transporting member 15 if necessary. As the toner T, it is desirable to use, for example, toner having a shape that is close to a spherical shape, such as polymerized toner.

Figure 2:
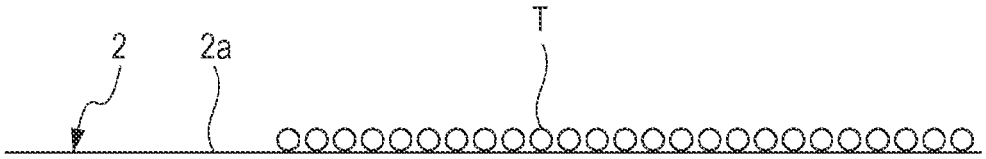
FIG. 2 is a schematic view of a toner layer formed on a toner carrying member.

An opposing roller 18 is disposed at a position opposing the developing roller 14 of the toner layer forming device 3 with the toner transporting member 2 being disposed therebetween. The opposing roller 18 is a roller whose metallic surface or cored bar surface is covered with a conductive synthetic resin layer. A development voltage is supplied from a power supply device (not shown) to the toner layer forming device 3 by supplying the development voltage to a location between the developing roller 14 and the opposing roller 18. A transfer voltage or a transfer current having a polarity that is opposite to a toner charging polarity is supplied to the opposing roller 18. As a result, as shown in FIG. 2, a substantially uniform toner layer formed by adherence of approximately one or two layers of toner T is formed on the surface of the toner carrying member 2. For example, the developing roller 14 and the stirring transporting member 15 to which power is transmitted from a rotationally driving device (not shown) rotate in a required direction. Further, although a one-component developer including only the toner T is used as the developer 12, obviously, a two-component developer including nonmagnetic toner and magnetic carriers may also be used.

The heating recording device 5 is disposed at the recording position 9 situated at a transport path of the toner carrying member 2 and where the heating recording device 5 contacts the back supporting roller 8 with the toner transporting member 2 and the recording paper 4 being disposed therebetween. As described later, the heating recording device 5 is one in which heating elements are disposed at an end portion (lower end portion in FIG. 1) of the heating recording device 5 that contacts the toner carrying member 2. The heating elements are linearly disposed in accordance with a predetermined recording density along a direction that crosses a direction of movement of the toner carrying member 2. Each heating element generates heat as a result of applying voltage or current thereto, and the heating temperature changes in accordance with a value of the current or the voltage that is applied.

Figure 3:
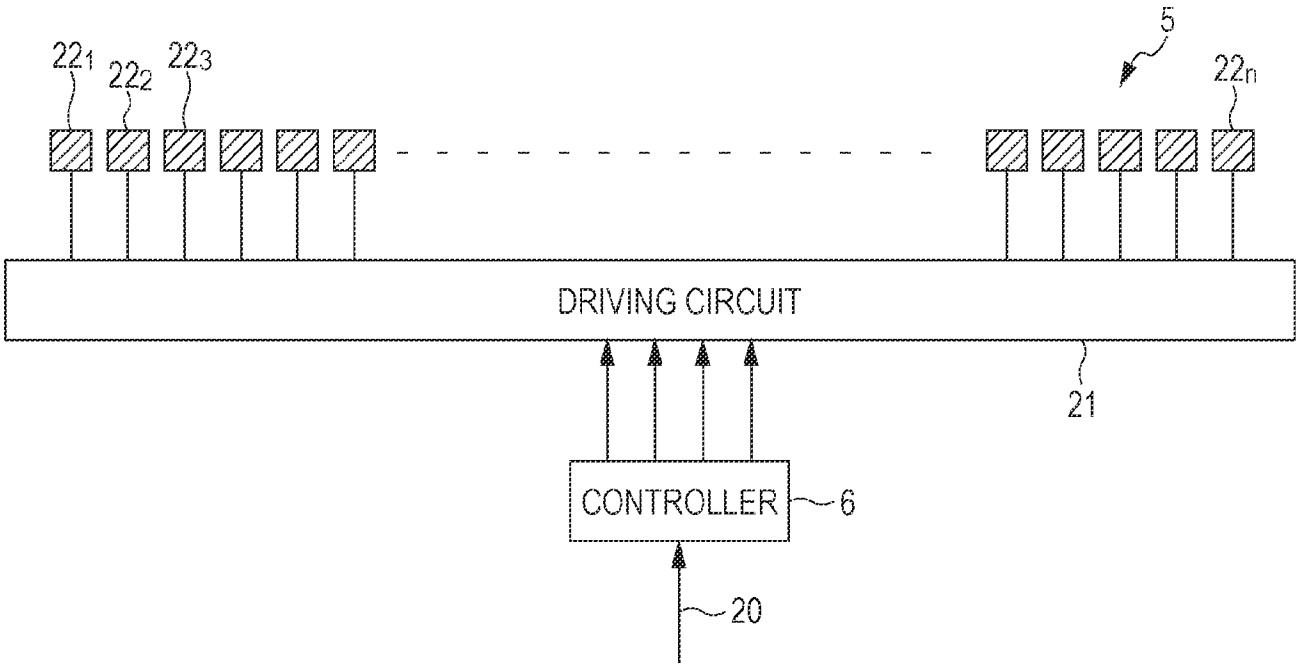
FIG. 3 shows a structure of a heating recording device.
Figure 4:
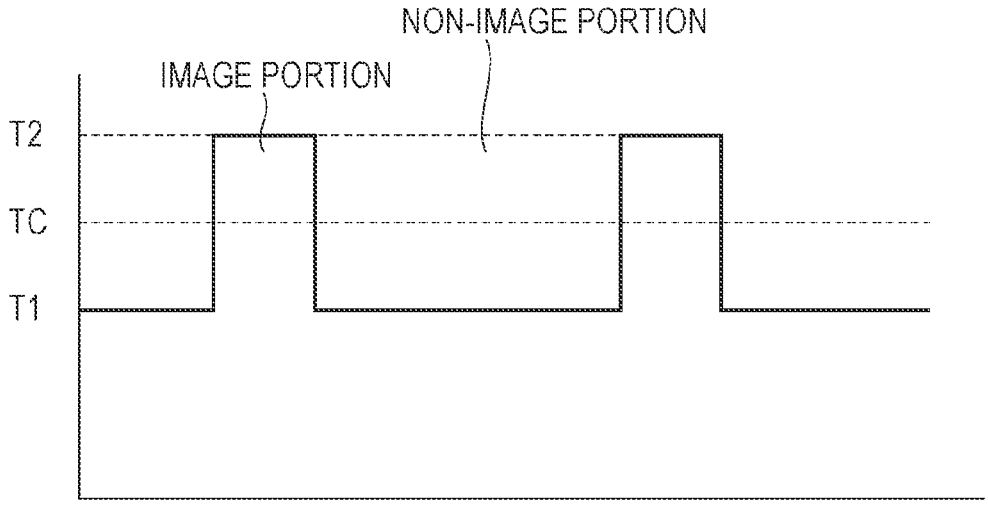
FIG. 4 shows a graph of temperatures of heating elements at an image portion and at a non-image portion of the heating recording device.
Figure 5:
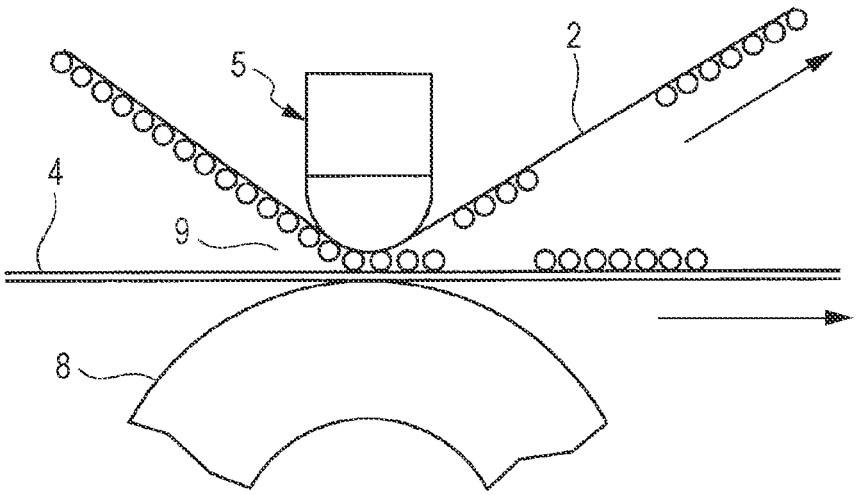
FIG. 5 is a schematic view illustrating a recording operation of the image recording apparatus according to the first exemplary embodiment of the present invention.

As shown in FIG. 3, the transferring device 6 includes a controller. The transferring device 6 controls the heating temperature of each heating element 22 at the image portion and the non-image portion of the heating recording device 5 through a driving circuit 21 on the basis of image information (signal) 20 that is input to the image recording apparatus 1, so that toner at the image portion is selectively transferred to a recording medium due to a difference between the temperature of the image portion and the temperature of the non-image portion. Although, in the exemplary embodiment, the toner at the image portion is fixed at the same time that it is transferred, the toner at the image portion may be fixed after the transfer. The driving circuit 21 is disposed at a side of the heating recording device 5. When an image is recorded, the controller 6 causes the heating elements ($\mathbf{22}_1$, $\mathbf{22}_2$, $\mathbf{22}_3$, . . . , $\mathbf{22}_n$) of the heating recording device 5 to generate heat at both the image portion and the non-image portion. Here, as shown in FIG. 4, a temperature (T2) of the image portion is set greater than or equal to a toner fixable temperature (Tc) of toner used to form a toner layer, whereas a temperature (T1) of the non-image portion is set less than the toner fixable temperature (Tc) of the toner used to form a toner layer, and greater than or equal to a glass transition temperature (Tg).

The image recording apparatus 1 further includes a temperature sensor 25 that detects environmental temperature. The controller 6 is formed so as to control the temperature T1 of the non-image portion in accordance with a temperature detected by the temperature sensor 25. Since the toner fixable temperature (Tc) is set relatively high, it is not easily influenced by a change in the environmental temperature. However, since the temperature (T1) of the non-image portion is a relatively low temperature that is set less than the toner fixable temperature (Tc) of the toner used to form a toner layer and greater than or equal to the glass transition temperature (Tg), the temperature (T1) of the non-image portion tends to be influenced by a change in the environmental temperature.

Therefore, in the exemplary embodiment, the image recording apparatus 1 includes the temperature sensor 25 that detects environmental temperature. When the temperature that is detected by the temperature sensor 25 is lower than a temperature of a threshold value that is a lower limit, the temperature (T1) of the non-image portion is set higher by a predetermined value. In contrast, when the temperature that is detected by the temperature sensor 25 is higher than a temperature of a threshold value that is an upper limit, the temperature (T1) of the non-image portion is set lower by a predetermined value.

Here, a temperature, which is the temperature of the non-image portion, that is set less than the toner fixable temperature (Tc) of the toner used to form a toner layer, and that is set greater than or equal to the glass transition temperature (Tg) is what is called a cold offset temperature. The cold offset temperature is a temperature that is greater than or equal to the glass transition temperature (Tg) of toner, and at which the toner is softened. The softened toner adheres to the toner carrying member 2 by attractive force that is generated as the toner is softened. However, since the cold offset temperature is less than the fixable temperature (Tc) of the toner T, the cold offset temperature is a temperature at which the toner T is neither transferred nor fixed to the recording paper 4.

Entire Image Recording Apparatus and Operation of Principal Portion

A basic image recording operation performed by the image recording apparatus 1 will hereunder be described.

When the image recording apparatus 1 receives information regarding a command for requesting the image recording operation (printing operation), the take-up roller 10 that takes up the toner carrying member 2, the toner layer forming device 3, etc., start.

As shown in FIG. 1, toner is supplied to a surface of the toner carrying member 2 from the developing roller 14 of the toner layer forming device 3, and is electrostatically attracted to the toner carrying member 2 from the back of the toner carrying member 2 by the opposing roller 18. As a result, the toner electrostatically adheres to the surface 2*a* of the toner carrying member 2, to form a toner layer. By this, as shown in FIG. 2, the toner layer that is substantially uniform is formed on the surface 2*a* of the toner carrying member 2.

Next, as shown in FIG. 3, when the toner carrying member 2 is transported to the recording position 9, the heating elements $\mathbf{22}_1$, $\mathbf{22}_2$, $\mathbf{22}_3$, . . . , $\mathbf{22}_n$ of the heating recording device 5 heat the toner carrying member 2 on the basis of the image signal 20, so that a toner image is transferred and fixed to the recording paper 4 at the same time in accordance with the image signal 20. When the toner carrying member 2 carrying a toner layer that has not been transferred to the recording paper 4 passes the recording position 9, the toner carrying member 2 is separated from the recording paper 4, and is taken up by the take-up roller 10.

Figure 6:
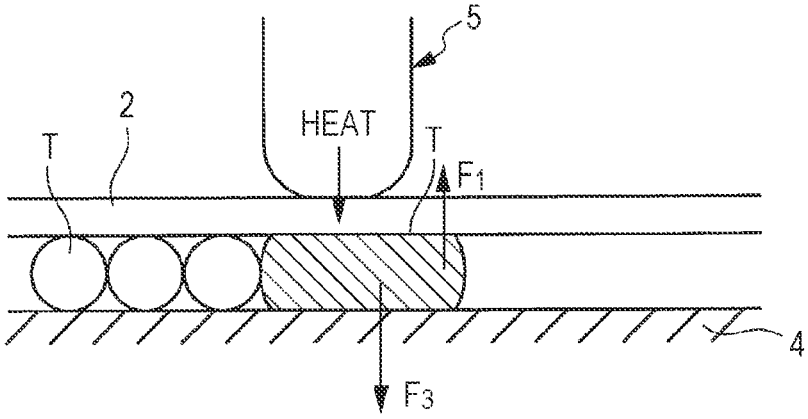
FIG. 6 illustrates a recorded state at the image portion of the heating recording device.

Here, the heating elements $\mathbf{22}_1$, $\mathbf{22}_2$, $\mathbf{22}_3$, . . . , $\mathbf{22}_n$ of the heating recording device 5 are such that the value of the current or the value of the voltage that is applied is controlled so that, at the image portion, the temperature becomes greater than or equal to the toner fixable temperature (Tc). As shown in FIG. 6, at the heating elements $\mathbf{22}_1$, $\mathbf{22}_2$, $\mathbf{22}_3$, . . . , $\mathbf{22}_n$ at the image portion, the toner T in the toner layer on the toner carrying member 2 is heated to a temperature that is greater than or equal to the toner fixable temperature (Tc), and becomes fused, so that the toner T is transferred and fixed to a surface of the recording paper at the same time. At this time, the toner T is heated to a temperature that is greater than or equal to the fixable temperature (Tc), and becomes fused in its entirety to the recording paper 4.

Figure 7:
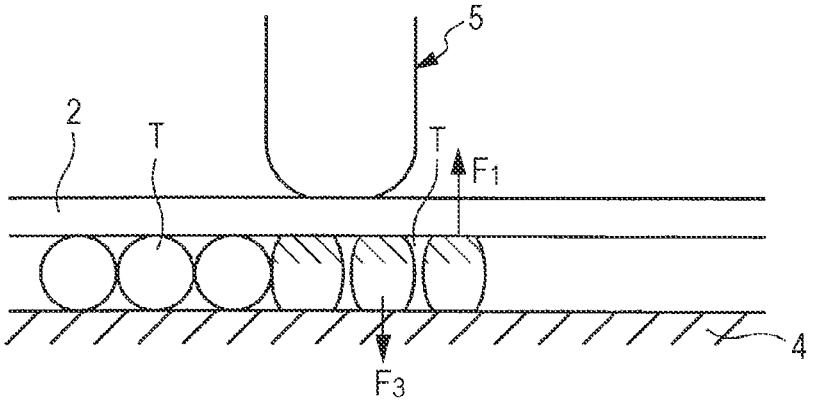
FIG. 7 illustrates a state of the non-image portion of the heating recording device.

In contrast, the heating elements $\mathbf{22}_1$, $\mathbf{22}_2$, $\mathbf{22}_3$, . . . , $\mathbf{22}_n$ of the heating recording device 5 at the non-image portion are such that the value of the current or the value of the voltage that is applied is controlled so that the temperature becomes greater than or equal to the glass transition temperature (Tg), and becomes less than the toner fixable temperature (Tc). Therefore, as shown in FIG. 7, at the heating elements $\mathbf{22}_1$, $\mathbf{22}_2$, $\mathbf{22}_3$, . . . , $\mathbf{22}_n$ at the non-image portion, what is called the cold offset state (in which the toner on the toner carrying member 2 is heated to a temperature that is greater than or equal to the glass transition temperature (Tg) and that is less than the toner fixable temperature (Tc)), becomes softened, and is affixed to the surface of the toner carrying member 2) occurs. At this time, the toner T at the side that is heated by the heating elements $\mathbf{22}_1$, $\mathbf{22}_2$, $\mathbf{22}_3$, . . . , $\mathbf{22}_n$ may be in a partially fused state. However, the toner T at the side of the recording paper 4 is not fused.

Figure 8:
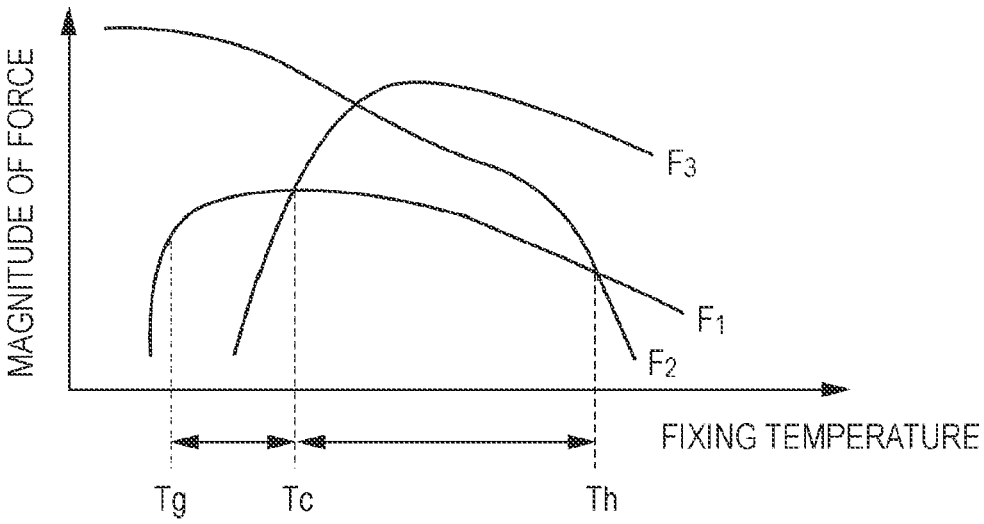
FIG. 8 is a graph of the relationships between fixing temperature and various forces that act upon toner.

FIG. 8 is a graph showing the relationship between fixing temperature and the magnitude of a force $F_1$, the magnitude of a force $F_3$, and the magnitude of a cohesive force $F_2$. The forces are indicated along the vertical axis, and the fixing temperature is indicated along the horizontal axis. The force $F_1$ acts between the toner T and the toner carrying member. The force $F_3$ acts between the toner and the recording paper 4. The force $F_2$ acts between toner portions.

As is clear from FIG. 8, the force $F_1$ that acts between the toner T and the toner carrying member 2 increases suddenly as the temperature of the toner T approaches the glass transition temperature (Tg), increases slightly from the glass transition temperature to the minimum fixable temperature (Tc), and, then, tends to decrease gradually when the minimum fixable temperature (Tc) is exceeded.

In contrast, the attractive force $F_3$ that acts between the toner T and the recording paper 4 remains a small value even if the temperature of the toner T exceeds the glass transition temperature (Tg), then, increases suddenly as the temperature of the toner T approaches the minimum fixable temperature (Tc), becomes greater than the attractive force acting between the toner T and the toner carrying member 2 at the minimum fixable temperature (Tc), and increases suddenly. Thereafter, the attractive force $F_3$ becomes a maximum value between the minimum fixable temperature (Tc) and a maximum fixable temperature (Th), and, then, tends to decrease by slight amounts.

The cohesive force $F_2$ of the toner T gradually decreases as the temperature of the toner T increases. When the maximum fixable temperature (Th) is exceeded, the cohesive force $F_2$ of the toner T becomes less than the attractive force $F_1$ that acts between the toner T and the toner carrying member 2, so that what is called a hot offset state, in which toner tends to remain on the toner carrying member 2, occurs.

In the exemplary embodiment, by making use of the above-described characteristics, the temperature of each of the heating elements $\mathbf{22}_1$, $\mathbf{22}_2$, $\mathbf{22}_3$, . . . , $\mathbf{22}_n$ of the heating recording device 5 is controlled so that, at the image portion, the temperature of each of the heating elements $\mathbf{22}_1$, $\mathbf{22}_2$, $\mathbf{22}_3$, . . . , $\mathbf{22}_n$ becomes greater than or equal to the toner fixable temperature (Tc), and so that, at the non-image portion, the temperature of each of the heating elements $\mathbf{22}_1$, $\mathbf{22}_2$, $\mathbf{22}_3$, . . . , $\mathbf{22}_n$ becomes greater than or equal to the glass transition temperature (Tg) and less than the toner fixable temperature (Tc).

As a result, at the image portion, as shown in FIG. 8, the attractive force $F_3$ that acts between the toner T and the recording paper 4 is greater than the attractive force $F_1$ that acts between the toner T and the toner carrying member 2. When the toner T in the toner layer carried by the toner carrying member 2 is transferred to the recording paper 4, the toner T is fixed at the same time.

At the non-image side, as shown in FIG. 8, the attractive force $F_1$ that acts between the toner T and the toner carrying member 2 is greater than the attractive force $F_3$ that acts between the toner T and the recording paper 4, so that the toner T is kept carried by the toner carrying member 2. This makes it possible to prevent the toner T from being transferred to the recording paper 4.

In this way, in the exemplary embodiment, the heating elements $\mathbf{22}_1$, $\mathbf{22}_2$, $\mathbf{22}_3$, . . . , $\mathbf{22}_n$ of the heating recording device 5 are caused to generate heat at both the image portion and the non-image portion. In addition, by making use of the relationships between the magnitude of the attractive force $F_3$ that acts between the toner T and the recording paper 4 and the magnitude of the attractive force $F_1$ that acts between the toner T and the toner carrying member 2, which result from the difference between the temperature at the image portion and the temperature at the non-image portion, the toner T at the non-image portion is such that a force acting at the side of the toner carrying member 2 is greater than the attractive force $F_3$ that acts between the toner T and the recording paper 4. Therefore, it is possible to prevent the generation of fog toner.

Second Exemplary Embodiment

Figure 9:
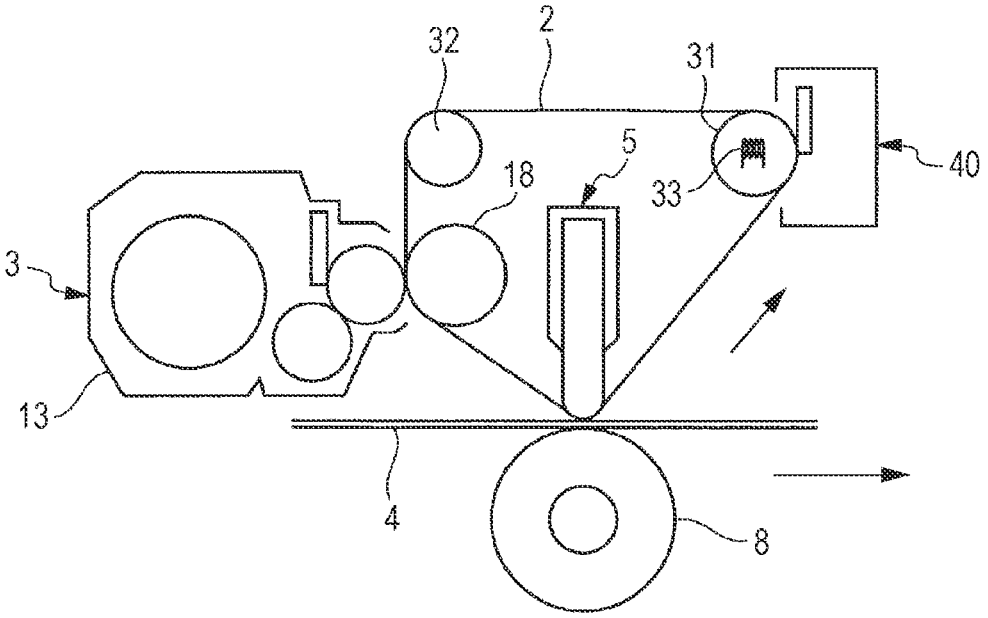
FIG. 9 shows a structure of an image recording apparatus according to a second exemplary embodiment of the present invention.
Figure 10:
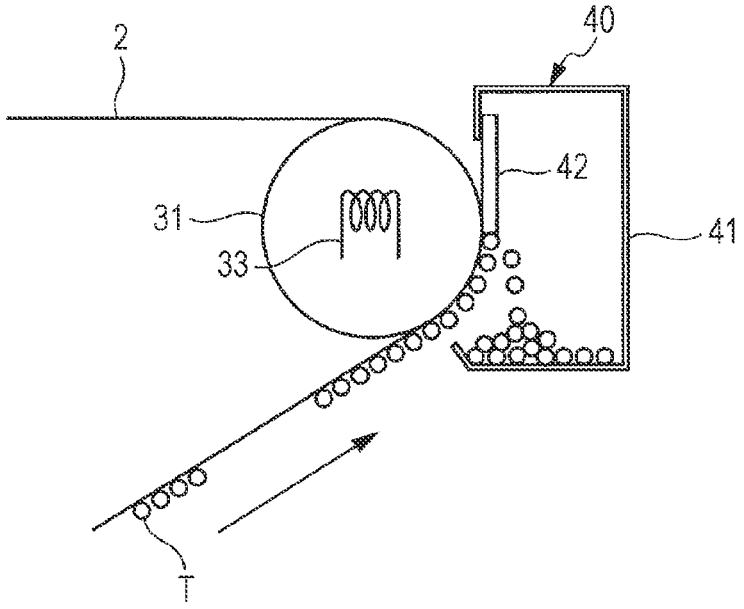
FIG. 10 shows a structure of a cleaning device.

FIGS. 9 and 10 each show an image recording apparatus 1 according to a second exemplary embodiment. FIG. 9 shows an entire structure of the image recording apparatus 1 according to the second exemplary embodiment. FIG. 10 shows a structure of a cleaning device 40 of the image recording apparatus 1 according to the second exemplary embodiment.

Entire Structure of Image Recording Apparatus

The image recording apparatus 1 according to the second exemplary embodiment is not one that transports a toner transporting member 2 in only one direction. The recording apparatus 1 according to the second exemplary embodiment is an endless belt that is placed upon supporting rollers 31 and 32, and that circulates and moves. The image recording apparatus 1 according to the second exemplary embodiment includes the cleaning device 40 that removes residual toner T remaining on the toner transporting member 2 after recording an image.

Of the rollers that support the toner transporting belt 2, the supporting roller 31 that is disposed at the position of the cleaning device 40 functions as a driving roller. The supporting roller 31 includes a heating source 33 therein, and is heated so that a surface temperature of the supporting roller 31 becomes greater than or equal to the minimum fixable temperature (Tc).

The cleaning device 40 includes a body 41 whose supporting-roller-31 side is open. A cleaning plate 42 that scrapes off any residual toner remaining on a surface of the toner transporting belt 2 that is wound upon the supporting roller 31 is provided at the opening of the body 41. As the cleaning blade 42, for example, a rubber blade is used.

Entire Image Recording Apparatus and Operation of Principal Portion

The basic image recording operation of the image recording apparatus 1 according to the second exemplary embodiment is similar to that of the image recording apparatus 1 according the above-described first exemplary embodiment.

In the second exemplary embodiment, after a toner image carried by the toner transporting belt 2 is transferred and fixed to recording paper 4 at the same time in accordance with an image signal, the toner transporting belt 2 to which any toner remaining after the transfer is stuck moves to the supporting roller 31. The supporting roller 31 that includes the heating source 33 therein and whose surface is heated to a temperature that is greater than or equal to the minimum fixable temperature (Tc) causes the toner transporting belt 2 as well as any residual toner remaining after the transfer to be heated. As a result, attractive force between the toner T and the toner transporting belt 2 is reduced, so that the toner T remaining on the toner transporting belt 2 is scraped off by the cleaning plate 42, and is collected in the internal portion of the body 41 of the cleaning device 40.

The toner transporting belt 2 from which the residual toner remaining after the transfer has been removed moves again towards a toner layer forming device 3, so that a toner layer is formed on the surface of the toner transporting belt 2.

In the second exemplary embodiment, the toner transporting belt 2 is repeatedly used. Therefore, as described above, in order to achieve good separability of toner remaining on the surface of the toner transporting belt 2, a layer providing separability is formed on the surface of the toner transporting member 2. The layer providing separability is formed of, for example, polytetrafluoroethylene (PTFE) or polytetrafluoroethylene-perfluoroalkylvinylether copolymer (PFA).

Accordingly, in the second exemplary embodiment, the cleaning device 40 cleans the surface of the toner transporting belt 2 after recording an image. By removing any toner remaining after the transfer, it is possible to repeatedly use the toner transporting belt 2 as a toner transporting member. In addition, since it is not necessary to replace the toner transporting member, convenience is enhanced for users.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image recording apparatus comprising:

a toner transporting member that transports a toner layer while carrying the toner layer on a first surface of the toner transporting member, the toner transporting member including the first surface and a second surface;

a heating unit including a plurality of heating elements that contact the second surface that is opposite to the first surface of the toner transporting member, and that generate heat in accordance with image information, the first surface contacting a recording medium and carrying the toner layer; and a transferring unit that selectively transfers toner at an image portion to the recording medium as a result of causing each heating element of the heating unit to generate the heat with a temperature of the heating elements at the image portion and a temperature of the heating elements at a non-image portion being different from each other.

2. The image recording apparatus according to claim 1, wherein each heating element of the heating unit causes the temperature of the image portion to be set greater than or equal to a toner fixable temperature of the toner used to form the toner layer, and the temperature of the non-image portion to be set less than the toner fixable temperature of the toner used to form the toner layer and greater than or equal to a glass transition temperature.

3. The image recording apparatus according to claim 1, further comprising a temperature detecting unit that detects environmental temperature, wherein the transferring unit changes the non-image portion temperature of the heating elements of the heating unit on the basis of a result of detection by the temperature detecting unit.

4. The image recording apparatus according to claim 1, wherein the toner transporting member is an endless belt.

5. The image recording apparatus according to claim 1, wherein the toner transporting member includes a cleaning unit that removes a residual toner layer remaining at the non-image portion.

* * * * *